United States Patent [19]

Book

[11] 4,003,097

[45] Jan. 18, 1977

[54] TWO LEVEL FLUSH TANK VALVE MECHANISM

[76] Inventor: Harold M. Book, 7730 Wildwood Road, P.O. Box No. 361, Findlay, Ohio 45840

[22] Filed: Sept. 19, 1975

[21] Appl. No.: 614,751

[52] U.S. Cl. ..... 4/67 A; 137/636.2

[51] Int. Cl.[2] ..... E03D 1/14

[58] Field of Search ..... 4/52, 56, 57 R, 60, 4/65, 67 A, DIG. 1; 137/636.2

[56] References Cited

UNITED STATES PATENTS

| | | | |
|---|---|---|---|
| 2,444,759 | 7/1948 | Smith | 4/65 X |
| 2,731,647 | 1/1956 | Groth et al. | 4/67 A |
| 2,839,759 | 6/1958 | Martino | 4/67 A X |
| 2,864,095 | 12/1958 | Martino | 4/67 A |
| 2,907,050 | 10/1959 | Harris | 4/56 |
| 3,237,211 | 3/1966 | Brown | 4/67 A X |
| 3,909,856 | 10/1975 | Dunn | 4/67 A |
| 3,916,455 | 11/1975 | Longdin | 4/67 A |

*Primary Examiner*—Richard E. Aegerter
*Assistant Examiner*—Stuart S. Levy

[57] ABSTRACT

A valve mechanism for draining a toilet flush tank to either one of two different drain levels selectively, chosen by a single manual bell-crank lever rockable in opposite directions connected to an adjustable link that pushes or pulls a rocking lever between two parallel ball valve tubular extensions having ball valves seated on outlets at the two different drain levels in the tank. At least one of the drain outlets may be vertically adjustable. The outlets may be formed in a manifold which connects into the single outlet of a standard toilet flush tank. The full tank level is controlled by a standard float valve at the top of an intake pipe in the tank. The refill tube from the float valve may be connected to a guide for one of the tubular extensions of a ball valve. These tubular extensions also act as overflow ducts for the tank. When the manual lever is pushed in one direction it rocks the rocking lever to urge one ball valve closed and opens the other ball valve, and when the manual lever is pulled in the opposite direction it urges the other ball valve closed and opens said one ball valve.

25 Claims, 5 Drawing Figures

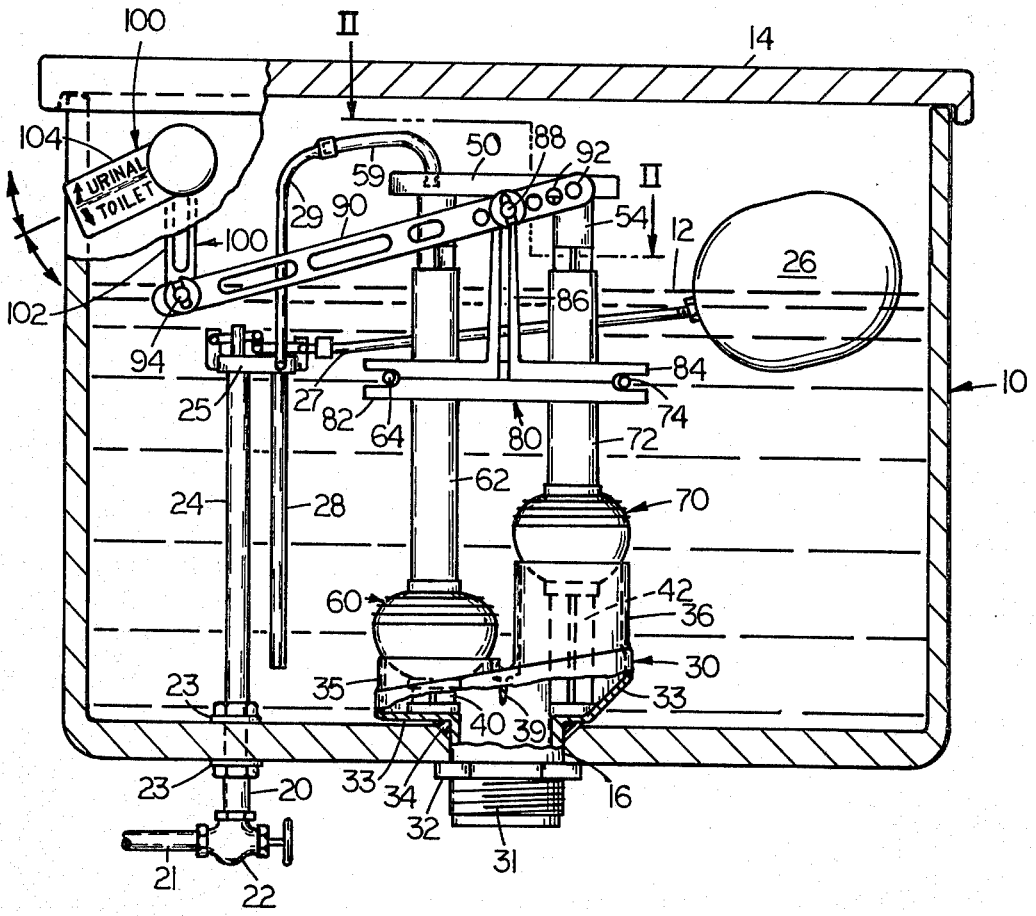
FIG. I
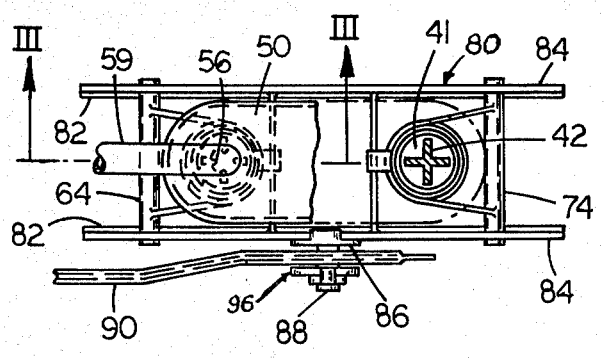
FIG. II
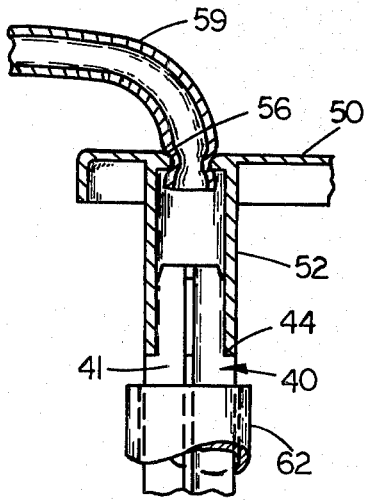
FIG. III

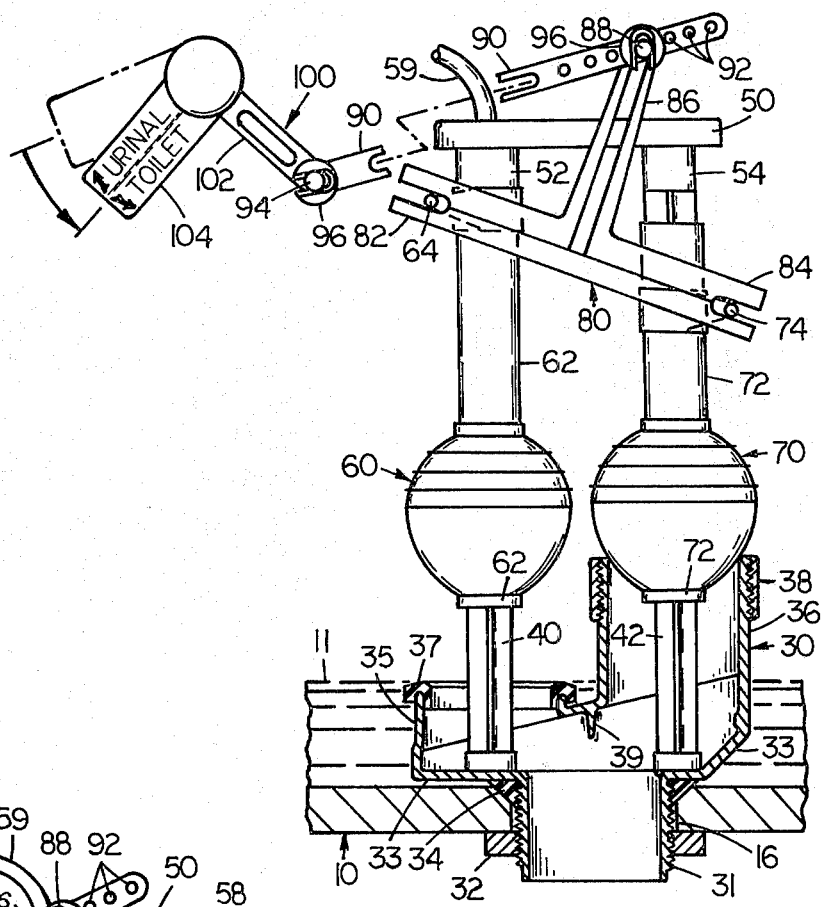
FIG. IV
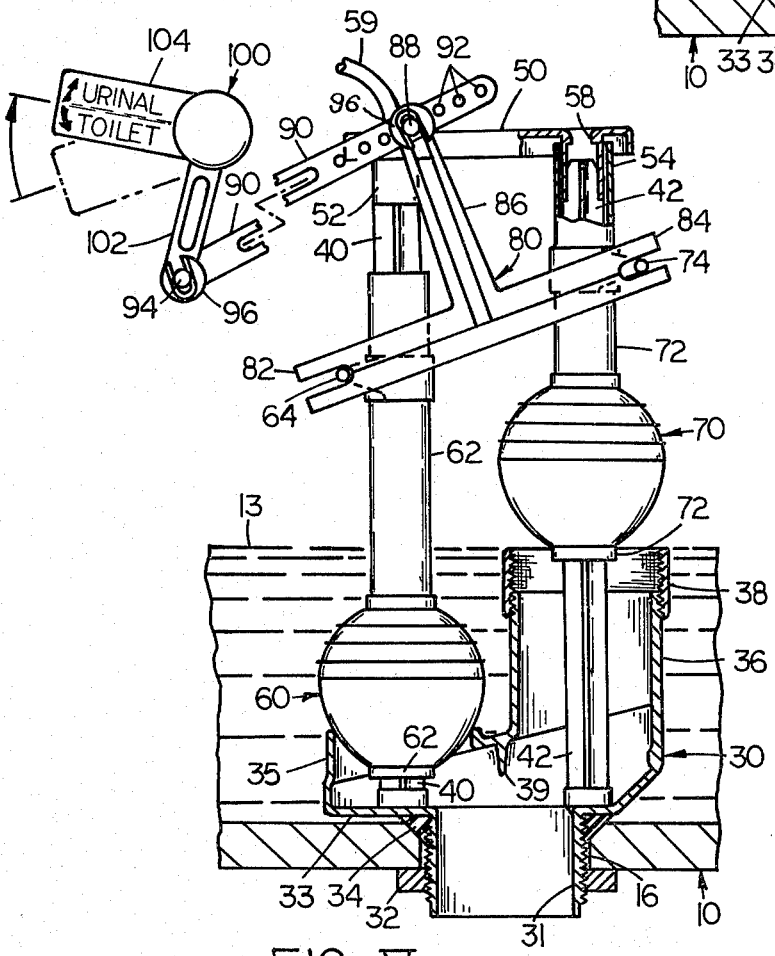
FIG. V

TWO LEVEL FLUSH TANK VALVE MECHANISM

BACKGROUND OF THE INVENTION

Previously two different level toilet flush tanks have been known in which the drain levels are selected either by two separate manual levers or by a single rockable lever in two different directions for raising ball valves at two different drain levels. However, for such valve mechanisms separate levers, pivots, and links have always been required for each drain valve with relatively complicated interacting camming contacts.

SUMMARY OF THE INVENTION

Generally speaking, the selective two drain levels for the tank according to this invention comprises a liquid tank having a full level, an intermediate drain level, and a lower drain level. This tank is provided with an inlet duct which, for toilet flush tanks, comprises a vertical riser tube with a float controlled valve at its upper end and a downward extension to direct the incoming liquid to the bottom of the tank. A branch outlet from this float valve connects to a toilet bowl refill tube that extends into the tank overflow pipe. Near the top edge of one side wall of the tank there is usually provided an aperture for journalling a rockable manual flushing lever. The tank is also usually provided with a removable cover, and a single outlet aperture near the center of the bottom of the tank.

The dual or two drain level outlet valve mechanism of this invention may comprise a manifold which fits the single outlet aperture in the bottom of the tank and provides two vertically spaced and horizontal drain outlet valve seats, one for the lower level and the other for the intermediate level. Either or both of these outlet seats may be vertically adjustable, such as by a threaded telescopic sleeve to vary its drain level. In between the ducts from these two drain outlets in the manifold there may be provided a baffle extending downwardly toward the single outlet of the tank to restrict reverse flow from one drain seat outlet into the other and direct all outlet flows toward the single tank outlet. Extending vertically upwardly from the centers of each of the two different level drain outlets in the manifold there may be provided ball valve guide posts, preferably having longitudinal channels along which liquid may flow. The top ends of these guide posts may be bridged by an inverted U-shaped bracket which may be easily removable for the replacement of the ball valves and through which bridge the toilet refill tube may be directed.

The ball valves which rest on the two different level drain outlets are hollow and have tubes extending through and above them guided on the posts, which tubes provide two overflow tubes for the liquid in the tank. Thus these tubes each extend slightly above the full level for the tank when both ball valves are seated or closed. The ball valves which seat in the drain outlets are preferably flexible, however their outlet seats may be provided with soft rims, if desired, and their extension tubes may be formed integrally with the balls. A fulcrum pivot is mounted on each of these vertical tubes above the ball valves which pivots are in a substantially horizontal plane when both ball valves are seated on their outlets.

Between the fulcrum pivots on the ball valve tube extensions is an inverted T-shaped rocker lever with its ends journalled in these fulcrum pivots. The outer end of the vertical extending leg of this T-shaped rocker has pivotally connected thereto one end of an adjustable length push-pull link, the other end of which link may be connected to one arm of a manually operated bell-crank lever journalled through a wall of the tank.

Thus when the manual bell-crank lever outside a toilet flush tank is lifted or rocked in one direction, the link is pulled to rock the rocking lever around one of its end fulcrum pivots to urge that corresponding ball valve towards its seat, while raising the other ball valve from its seat to drain the tank to the level of the drain outlet opened by the raised ball valve. Then if the manual bell-crank lever is pushed or rocked in the other direction, the other ball valve is urged towards its seat, while said one or first ball valve is raised to drain the tank to the level of the drain outlet opened by said one ball valve. Furthermore, the manual bell-crank lever also can be operated to close positively both of the ball valves by moving the bell-crank to its center or neutral position, thus preventing overflow of the toilet bowl in the event that the toilet bowl outlet becomes clogged. After the tank has drained to its selected level, the float of the float valve has lowered to open the intake float valve so that the tank refills again until the float closes the intake valve. During this filling of the tank the toilet bowl refill tube by-passes liquid through an aperture in the top of the bridge for the guide posts and thence down through the center of one of the overflow tubular extensions of one of the ball valves and along the channel in its guide post for maintaining water in the toilet bowl.

All of the parts of this dual outlet valve mechanism may be made of plastic, including the manifold, the two ball valves with their extension overflow tubes, the guide posts, their bridge, and all the links and levers, and even the pins for fastening the parts together.

OBJECTS AND ADVANTAGES

Accordingly it is an object of this invention to produce a simple, efficient, effective, and economic two level flush tank valve mechanism whereby the amount of water is materially reduced for flushing a toilet which has only been used as a urinal.

Another object is to produce such a mechanism that can be adapted easily to and installed in most standard toilet flush tanks.

Another object is to produce such a valve mechanism which is leak proof and positively operates both the opening and the closing of the outlets for two different levels in a tank.

Still another object is to produce such a valve mechanism which is easily adjustable, including the height of the drain levels to which the tank is to be drained.

A further object is to provide a flush tank which has a double overflow tube, and may be made entirely of plastic or other non-corrosive material.

BRIEF DESCRIPTION OF THE VIEWS

The above mentioned and other features, objects, and advantages, and the manner of obtaining them are described more specifically below by reference to an embodiment of this invention shown in the accompanying drawings wherein:

FIG. 1 is a vertical section through a standard toilet flush tank showing its intake float valve, its single bottom outlet, and the two different drain level ball valves and their operating mechanism installed therein according to one embodiment of the present invention;

FIG. II is an enlarged sectional view taken along line II—II of FIG. I showing the top of the refill tube connection and the overflow tubes, the guides for the ball valves, and the fulcrum pivots for the rocker levers that operate the ball valves;

FIG. III is a further enlarged vertical section taken along line III—III of FIG. II showing the connection of the refill tube into one of the overflow tubes and its guide post;

FIG. IV is an enlarged side elevation, with parts broken away, showing the valve mechanism of FIG. I in its position for draining the tank to its lower level; and FIG. V is a view similar to FIG. IV showing the valve mechanism of FIG. I in its position for draining the tank to its intermediate level.

DETAILED DESCRIPTION OF A PREFERRED EMBODIMENT

Referring to FIG. I there is shown a standard type toilet flush tank 10 filed with water to its normal full level 12 and having a removable cover 14, a single central outlet aperture 16 in the central bottom of the tank, and an inlet duct 20 connected to a water supply duct 21 through a valve 22. This inlet duct 20 extends through a second aperture in the bottom of the tank sealed by washers 23 forming a riser tube 24, at the upper end of which is provided a float control valve 25, opened and closed by the lowering and raising of a float 26 that floats on the water level in the tank and connects to the valve 25 by a lever arm 27. From the outlet of inlet valve 25 there is provided a down spout 28 and a by-pass toilet bowl refill tube 29. Thus when the water level 12 in the tank 10 lowers to one of the drain outlets in the tank, the valve 25 opens to permit water to flow through the ducts 20, 24 and 28 to fill the tank back up to its full level 12 as well as passing water through the refill tube 29 that extends to pass water down through an overflow tube 62 (described later) and the outlet 16 to refill the toilet bowl.

Referring now to FIGS. I, IV, and V, the outlet 16 in the bottom of the tank 10 is herein shown to be provided with a manifold 30 which comprises a single lower neck portion 31 threaded for attaching a fastening nut 32 for holding the flanged portion 33 of the manifold against a gasket 34 to seal the manifold 30 into this aperture 16. Extending upwardly, parallel and offset from the axis of the outlet neck 31, are two different vertically height lower and intermediate outlet extensions 35 and 36, the upper horizontal edges of each of which provide seats for the ball valves 60 and 70, respectively, which seats also act as overflow edges for the two different drain levels for the liquid in the tank. Either or both of these overflow edges as shown in FIG. IV may be provided with a soft resilient annular seat 37, if desired, such as made out of spongy rubber material, and/or either or both of these two extensions 35 and 36 may be to provide with threaded telescopic sleeve portions 38, as shown in FIGS. IV and V to adjust the height of their drain levels 11 and 13. In the manifold 30 between the two duct extensions 35 and 36, there may be provided a partition 39 for directing the out-flowing liquid from either of the drain seats downwardly through the neck duct 31 to avoid any return upward flow of liquid into the other adjacent extension.

Axially upwardly from and attached to the flange portion 33 of the manifold 30 and extending outwardly through the center of each of the drain outlet seats on extensions 35 and 36, there are provided a pair of parallel guide posts or columns 40 and 42 having longitudinal channels 41 (see FIG. II). These posts 40 and 42 extend to the same height upwardly above the full level 12 of the tank, and below the cover 14. The outer upper ends of these guide posts 40 and 42 may be anchored together by a bridging member 50 which has a pair of spaced downward hollow extension tubes 52 and 54, the upper ends of which are provided with apertures 56 and 58. One of these apertures, such as 56, may be anchored to a flexible hose extension 59 connected to the refill tube 29. The upper ends of these uniformly cross-sectioned guide posts 40 and 42 may be notched at 44 (see FIG. III) for engagement with the two extensions 52 and 54 of the bridge 50 and to permit flow of liquid from the refill tube 59 down through the extension 52 and along the channels 41 in the guide 40 inside overflow tube 62 down into the manifold 30 and out through an outlet 31.

Surrounding each of these guide posts 40 and 42 are the ball valves 60 and 70 with their attached tubular extensions 62 and 72, respectively, which tubular extensions may extend completely through the hollow ball valves 60 and 70 for more accurate guiding of the vertical movement of the ball valves up and down to open and close their drain outlet seats on the manifold extensions 35 and 36. When the two ball valves 60 and 70 are seated as shown in FIG. I, the upper ends of their respective extension tubes 62 and 72 are at the same horizontal level slightly above the normal full level 12 in the tank 10, so as to act as a pair of overflow tubes for the tank in the event the inlet valve does not operate properly and does not shut off the intake liquid into the tank. Thus there is an insurance of having two overflow tubes 62 and 72, each of which will permit water to flow down through them and the channels 41 in the guide posts 40 and 42 into the manifold duct 30 and out into the toilet bowl (not shown) connected to the outlet duct 31 from the manifold 30.

Also the bridge member 50 acts as a stop to limit the upward movement of each of the valves 60 and 70 by contact with the upper ends of their tubes 62 and 72, respectively, as shown in FIGS. IV and V. Fixedly mounted on the outside of the overflow ball valve extension tubes 62 and 72 are fulcrum pivots 64 and 74, respectively, (see also FIG. II), which may comprise a pair of trunions which fit into forked ends 82 and 84 of the walking beam or inverted T-shaped rocking beam member 80.

This rocker 80 extends between the two fulcrum pivots 64 and 74 which normally are in relatively horizontal plane when the ball valves 60 and 70 are in their closed position as shown in FIG. I. This rocker 80 rocks or tilts upwardly at each end alternately to raise its corresponding ball valve off of its seat as clearly shown in FIGS. IV and V. This rocker 80 is provided with a central vertically or perpendicularly extending lever arm 86 or leg of its T-shape, which arm 86 has at its outer end a pivotal connection 88 to a link 90.

This push-pull link 90 may have a plurality of apertures 92 at the one end whereby its effective length may be adjusted for connection to the pivot 88 depending upon the average distance between this pivot 88 and the manual bell-crank lever 100 which operates this valve mechanism. The other end of this link 90 is provided with a pivoted connection 94 which is fastened to arm 102 of the bell-crank lever 100. The pivotal connections at the ends of link 90 may be releasably held together by split resilient clips 96.

This bell-crank lever 100 is journalled in an aperture in the upper side wall of the tank 10 as shown in FIG. I, and has its manual lever 104 outside the tank 10 which may indicate its two different directions of oscillation for pushing and pulling the link 90 to rock the rocker 80. The angle between the arms 102 and 104 of this bell-crank lever 100 may be adjusted, as desired, such as by complementarily splined telescopic axle portions (not shown).

The operation of the valve mechanism of this invention to drain completely a full flush tank 10, from level 12 to level 11 is shown in FIG. IV. Therein the manual arm 104 of the bell-crank lever 100 is pressed downwardly in "Toilet" direction which pushes the link 90 to rock the rocking lever 80 so as to fulcrum around the pivot 74 and urge the upper ball valve 70 into its seat around the manifold extension 36 and simultaneously raise the lower ball valve 60 and its corresponding overflow tube 62 into the position shown in FIG. IV to drain the tank down to the level 11 when the hollow ball valve 60, which floats on this liquid level, seats in or closes its seat at the upper end of the extension 35. In the meantime the float 26 has lowered to open the intake valve 25 so that the tank 10 will fill up again to the level 12 as shown in FIG. I.

If only part of the tank 10 is to be flushed or drained, such as in the case of flushing a urinal, then the manual lever 104 of the bell-crank lever 100 is raised in "Urinal" direction which pulls the link 90 to rock the rocker 80 into the position shown in FIG. V, so as to fulcrum around pivot 64 to urge the lower ball valve 60 into its seat on the outlet extension 35 and simultaneously raise the ball valve 70 from its seat with its overflow tube 72 so that the tank will drain to the level 13. When the level 13 is reached, the hollow ball valve 70 floats down onto its seat on the extension 36 to close its outlet, and in the meantime the float valve 26 has been lowered sufficiently to open the intake valve 25 to fill up the tank again to the level 12 as shown in FIG. I.

Although all of the parts of this valve mechanism may be made of plastic, they also all or part may be made of metal or of other material, as desired, without departing from the scope of this invention. Furthermore, instead of the manifold device 30, the tank 10 may be made with two separated outlets, and instead of the bell-crank lever 100 and/or the link 90, the rocker 80 may be directly operated by other means without departing from the scope of this invention. Also, the refill tube 59 may be put into the other hole 54 in the bridge member 50, or there may be a pair of refill tubes one for each hole 54 and 56.

While there is described above the principles of this invention in connection with specific apparatus, it is to be clearly understood that this description is made only as a way of example and not as a limitation to the scope of this invention.

I claim:

1. A valve mechanism for draining liquid from a tank having two vertically spaced drain levels, comprising:

A. a tank having an outlet means at each of said levels,

B. a guide means mounted in said tank for each said outlet means,

C. a movable valve normally closing each outlet means, each valve having an overflow tube connected thereto, each said valve and over flow tube being guided for vertical movement along each said guide means, D. a fulcrum pivot mounted on each said overflow tube, E. a rocking lever having opposite ends journalled in said fulcrum pivots, and having an offset intermediate link pivot, and F. a push-pull link attached to said link pivot for opening one valve while holding the other closed, and vice versa.

2. A valve mechanism according to claim 1 wherein said tank is a toilet flush tank.

3. A valve mechanism according to claim 1 wherein all of said valves, lever, and link are made of plastic.

4. A valve mechanism according to claim 1 wherein said tank has a single inlet with a float valve controlled by the liquid level in the tank, which float valve has a by-pass refill tube connected to one outlet of the tank.

5. A valve mechanism according to claim 1 wherein said valves are ball valves and said tank outlets have horizontal openings forming valve seats for said ball valves.

6. A valve mechanism according to claim 5 wherein each tank outlet is provided with a soft flexible seat.

7. A valve mechanism according to claim 5 wherein one of said tank outlets is provided with an adjustable vertical telescopic extension for changing the outlet level.

8. A valve mechanism according to claim 1 wherein said tank outlets are formed in a manifold connected to a single outlet in the bottom of said tank.

9. A valve mechanism according to claim 1 wherein said valves comprise hollow ball valves.

10. A valve mechanism according to claim 1 wherein said rocking lever is an inverted T-shaped lever.

11. A valve mechanism according to claim 1 wherein said push-pull link moves substantially transversely with respect to the vertical movement of said valves.

12. A valve mechanism according to claim 1 wherein said push-pull link is provided with means for adjusting its length.

13. A valve mechanism according to claim 1 including manual means outside of said tank for operating said link.

14. A valve mechanism according to claim 13 wherein said manual means comprises a bell-crank lever oscillatable in two directions.

15. A valve mechanism according to claim 1 wherein said guide means are parallel and extend vertically out of each outlet and are surrounded by said overflow tubes.

16. A valve mechanism according to claim 15 wherein said guide means bridged at their upper ends by a removable apertured member adapted for fastening a refill tube from an inlet valve.

17. In a flush tank having an outlet and inlet and a float operated valve controlling the flow of liquid through said inlet, the improvement comprising:

A. a manifold connected to said outlet in said tank, said manifold having two vertically spaced horizontally open drain outlets in said tank, B. a vertical post extending upwardly in said tank in each manifold drain outlet, C. a ball valve mounted on an overflow tube extending through said ball valve and being slidable on each post and seating its corresponding one of said drain outlets, D. a fulcrum mounted on each tube, E. a rocking lever between said tubes and having its ends pivoted in said fulcrums, said rocking lever having a link pivot extension thereon, F. a bell-crank lever mounted on and through a side of said tank, and G. a push-pull link connected between said bell-crank lever inside said tank and said link pivot on said rocking lever whereby movement of said bell-crank lever outside said tank in one direction presses one ball valve seated on its drain outlet and raises the other ball valve from the other drain outlet, and the movement of said bell-crank lever in the other direction presses said other ball valve seated on said other drain outlet and raises one ball valve from its drain outlet.

18. A tank according to claim 17 wherein said tank outlet is centrally located in the bottom of said tank.

19. A tank according to claim 17 wherein said manifold drain outlets have soft annular seats.

20. A tank according to claim 17 wherein said manifold is provided with a central partition between said two drain outlets extending towards said tank outlet.

21. A tank according to claim 17 wherein the upper one of said drain outlets has a ball valve seat which is vertically adjustable.

22. A tank according to claim 17 including a bridging member connecting the upper ends of said posts.

23. A tank according to claim 22 wherein said bridging member is provided with an aperture for connection of a refill tube from the float valve to one of said overflow tubes.

24. A tank according to claim 17 wherein said overflow tubes form two parallel equal height overflow outlets for said tank when both said ball valves are seated on their drain outlets.

25. A tank according to claim 17 wherein said push-pull link includes means to adjust its effective length.

* * * * *

PO-1050
(5/69)

UNITED STATES PATENT OFFICE
CERTIFICATE OF CORRECTION

Patent No. 4,003,097 Dated January 18, 1977

Inventor(s) Harold M. BOOK

It is certified that error appears in the above-identified patent and that said Letters Patent are hereby corrected as shown below:

Column 3, line 20, change "filed" to - - filled - -; line 57, change "be to provide" to - - be provided - -. Column 4, line 19, change "an" to - - the - - .

Signed and Sealed this

Third Day of May 1977

[SEAL]

*Attest:*

RUTH C. MASON
*Attesting Officer*

C. MARSHALL DANN
*Commissioner of Patents and Trademarks*